US008257135B2

(12) United States Patent
Arcovio

(10) Patent No.: US 8,257,135 B2
(45) Date of Patent: Sep. 4, 2012

(54) SPINNING TOWEL ASSEMBLY

(76) Inventor: Andrew M. Arcovio, Charlotte, NC (US)

( * ) Notice: Subject to any disclaimer, the term of this patent is extended or adjusted under 35 U.S.C. 154(b) by 225 days.

(21) Appl. No.: 12/846,758

(22) Filed: Jul. 29, 2010

(65) Prior Publication Data

US 2011/0028065 A1 Feb. 3, 2011

Related U.S. Application Data

(60) Provisional application No. 61/229,383, filed on Jul. 29, 2009.

(51) Int. Cl.
*A63H 1/24* (2006.01)

(52) U.S. Cl. ..... 446/242

(58) Field of Classification Search ..... 446/242
See application file for complete search history.

(56) References Cited

U.S. PATENT DOCUMENTS

| | | | | |
|---|---|---|---|---|
| 4,913,940 | A | 4/1990 | Pratt | |
| 5,904,116 | A * | 5/1999 | Wyner et al. | 116/173 |
| 6,371,043 | B1 | 4/2002 | Pearison | |
| 6,467,939 | B2 | 10/2002 | Deutsch et al. | |
| 6,575,808 | B1 | 6/2003 | Wright et al. | |
| D501,893 | S | 2/2005 | Puett, III | |
| 6,913,233 | B2 | 7/2005 | Puett, III et al. | |
| 7,251,838 | B1 | 8/2007 | Rumbaugh et al. | |
| D555,739 | S | 11/2007 | Brown | |
| 7,367,148 | B2 | 5/2008 | Moody | |
| 2007/0094772 | A1 | 5/2007 | Scanlon et al. | |

* cited by examiner

*Primary Examiner* — Michael Dennis
(74) *Attorney, Agent, or Firm* — Summa, Additon & Ashe, P.A.

(57) ABSTRACT

A rally towel spins about an axis and is adapted to be hand held for use at sporting events or other gatherings. The towel has the shape of an air foil with a leading edge that is thicker than a trailing edge for improved lift and longer duration of rotation about the axis. The axis may be in the form of a pin that attaches the towel to a grip. The grip may have a shape that coincides with the sporting event or other arena in which the rally towel is used. The rally towel may include lighting and attachment mechanisms for additional advertising.

2 Claims, 6 Drawing Sheets

SPINNING TOWEL ASSEMBLY

CROSS-REFERENCE TO RELATED APPLICATIONS

This application claims the benefit of priority to U.S. Provisional Patent Application Ser. No. 61/229,383 entitled Spinning Towel Assembly, and filed on Jul. 29, 2009. The entire disclosure of the provisional patent application is incorporated by reference as if set forth in its entirety herein.

FIELD OF THE INVENTION

The invention relates to the field of hand-held rally towels for use at sporting events or other gatherings and that spin about an axis from a handle.

BACKGROUND OF THE INVENTION

The invention relates to the use of "rally towels" at sporting events or other gatherings. These towels, which typically include a team logo or mascot, may be sold or given away at sporting events. During the event, the fans wave or spin the towels to show their support for the team. The towels may be retained after the event as a souvenir. A rally towel also may include advertising material, for example, sponsor information on the surface of the rally towel.

Rally towels of the prior art, however, are often cumbersome and tiring to use. The individual's arm gets tired of waving a towel that is loose and held by hand. Towels associated with handles are often cumbersome, heavy, and tiring to spin. There is a need in the art of rally towels, therefore, for a rally towel that is easier to support and provides a longer lasting spin with less effort on the part of the user.

BRIEF SUMMARY OF THE INVENTION

The invention is a spinning towel assembly that may be used or sold at sporting events, corporate events, or other gatherings to allow fans to spin towels easily and effectively and thereby demonstrate their support for their team or group. As discussed herein, the spinning towel assembly may be customized to relate to a particular sport or a particular team or to include sponsor information or other advertisement. Typically, the rally towel will have a printed image on the surface of the towel.

The rally towel of this invention includes an assembly that provides an efficient means of rotating a towel about an axis, and the towel maintains its rotation longer with less energy consumption. The rally towel accomplishes this efficiency via a collar that has a low coefficient of friction with an axis of rotation in the form of a pin. The towel may also have aerodynamic qualities that allow rotation to last longer about an axis.

BRIEF DESCRIPTION OF THE DRAWINGS

FIGS. 1-6 depict various embodiments of the spinning towel assembly of the invention as set forth below:

FIG. 1 depicts a spinning towel assembly with an outer grip.

FIG. 2 depicts a spinning towel assembly with an outer grip and directional arrows depicting a leading edge and a trailing edge of the spinning towel.

FIG. 3 depicts a spinning towel assembly in a resting position with the leading edge draping around the user's hand.

FIG. 6 depicts a spinning towel assembly in the shape of a sock.

DETAILED DESCRIPTION OF THE INVENTION

Figure 1:
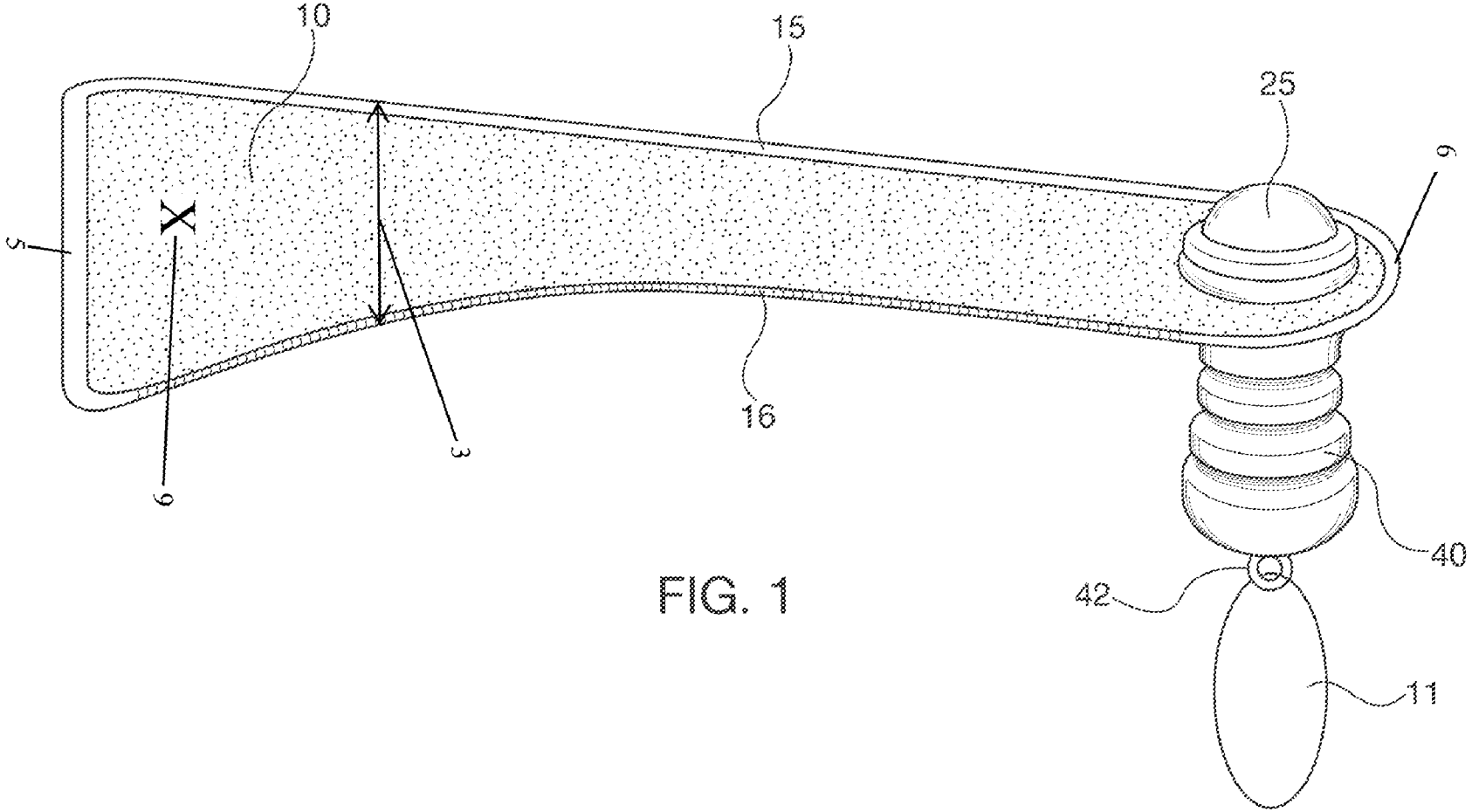
Figure 2:
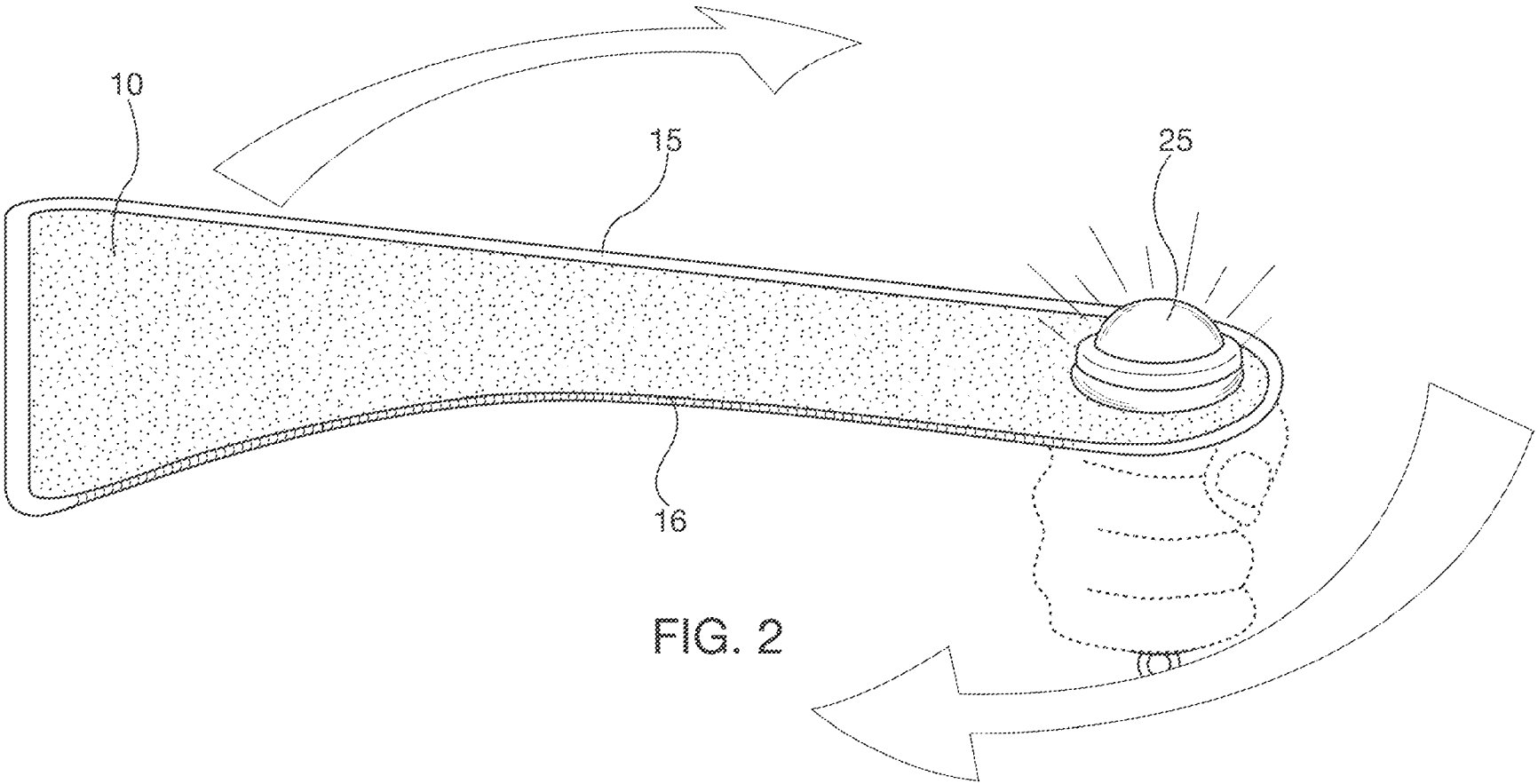
Figure 3:
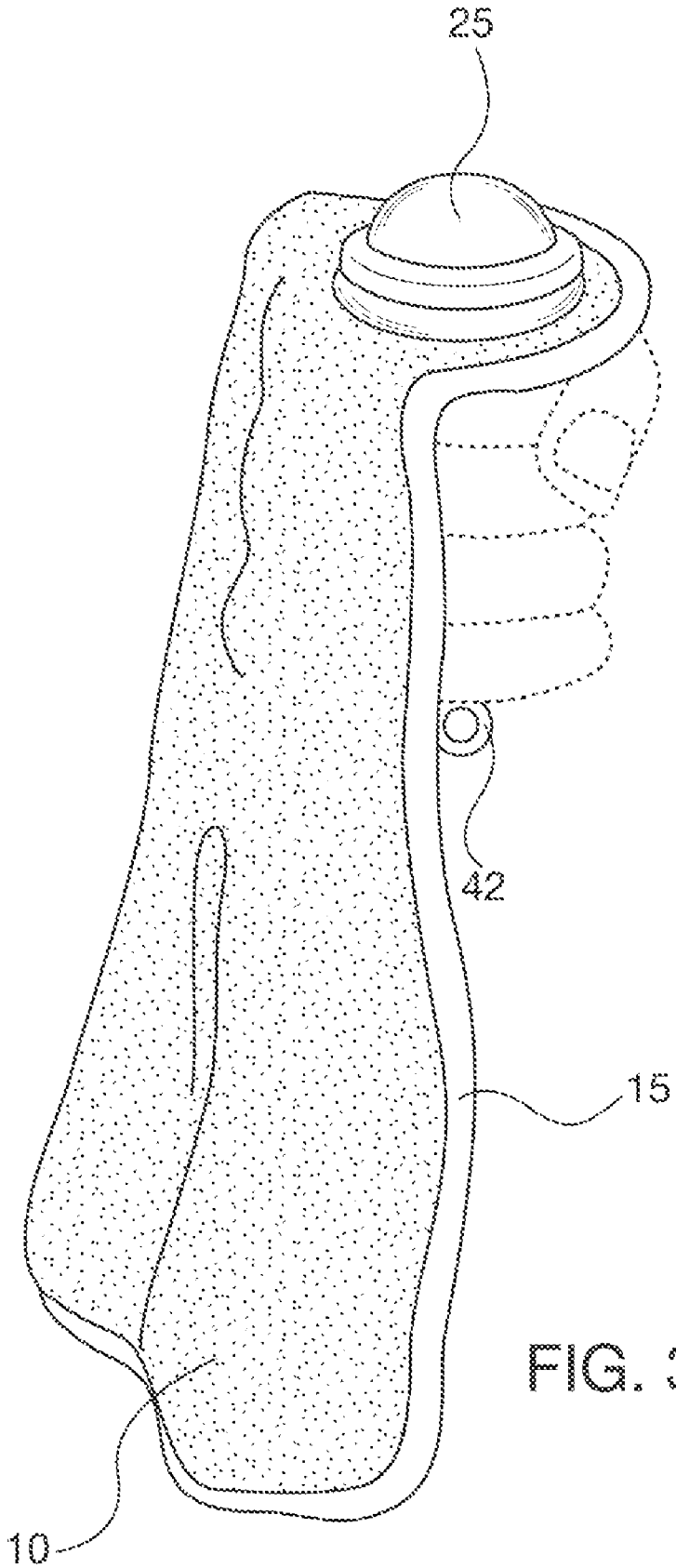

The invention is a spinning towel assembly which, for example, may be used or sold at sporting events, corporate events, or any other gathering to allow fans to spin towels and thereby demonstrate their support for a team, a group, or any common cause. As shown in the Figures, the spinning towel assembly may be customized to relate to a particular sport or a particular team or to include sponsor information or other advertisements thereon. Though not shown in the drawings, the towel will typically have a printed image on a surface of the towel and may come in suitable colors of the user's choice.

As used herein, the term "towel" encompasses any structure that is amenable to spinning about an axis. In one non-limiting example, the spinning towel may refer to a "rally towel." The term "towel" is not limited to any particular composition or shape. The towel may be made of fabrics (both natural and synthetic), plastic, rubber, woven materials, nonwoven materials, paper, felt, or any other desirable materials. The invention includes structures that are predominantly solids having various elasticity characteristics and densities. Other features may be incorporated into the assembly, including fluorescent materials, glow-in-the-dark materials, and the like. The term "towel" is used hereinafter as a matter of convenience and is not limiting of the invention.

The rally towel of this invention is often described in this specification as being used at a sporting event to show support for a team. That use is for example only, and the rally towel could be useful for business gatherings, family reunions, church events, charity events, or any gathering or activity where waving a towel is a fun way to show unity or support for a cause. The spinning towel assembly can also be used in emergency situations to flag down assistance.

Figure 5A:
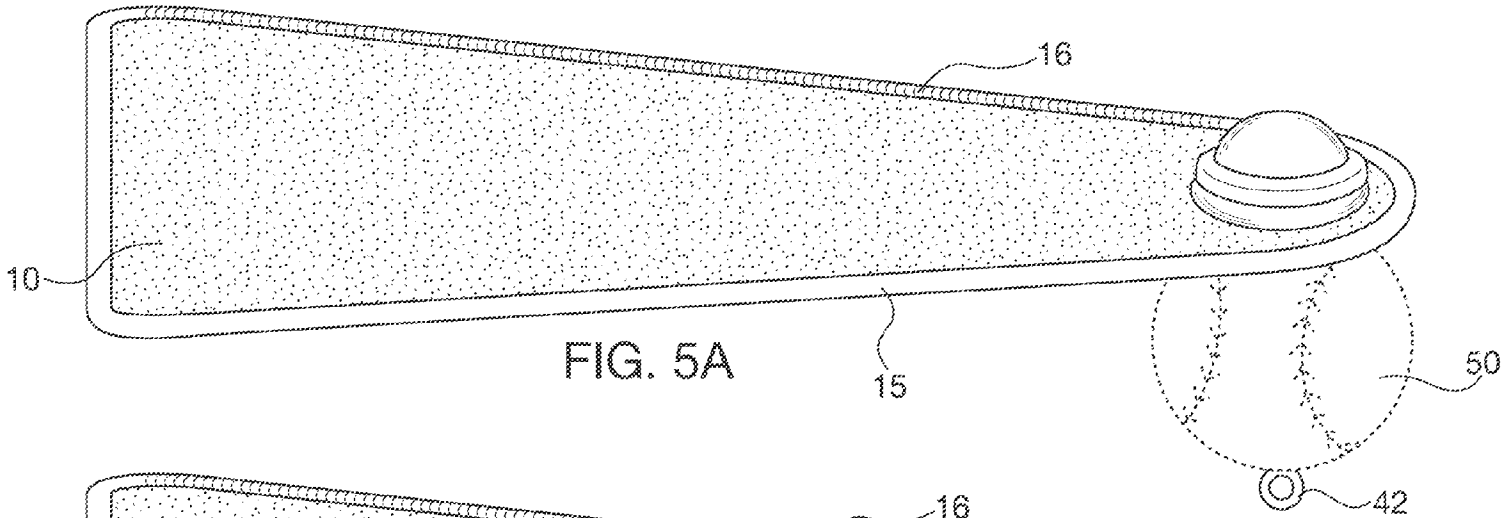
FIG. 5A depicts a spinning towel assembly with a baseball-shaped grip.
Figure 5B:
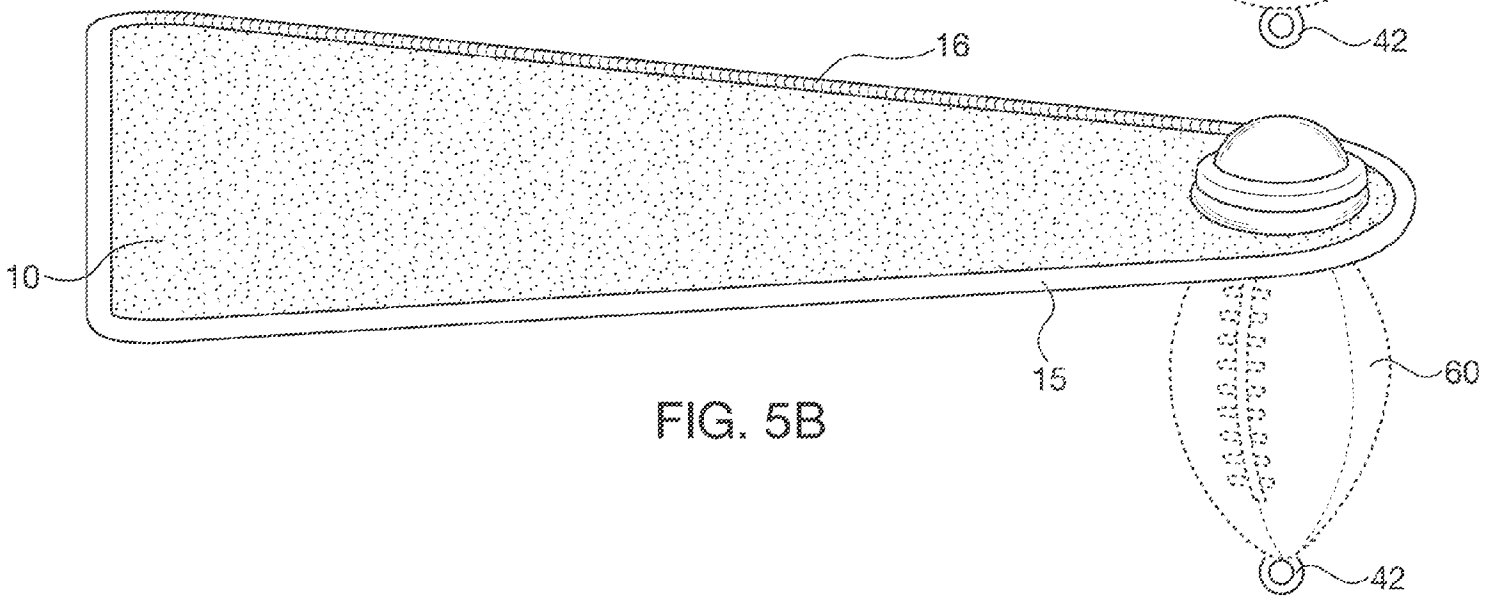
FIG. 5B depicts a spinning towel assembly with a football-shaped grip.

The spinning towel assembly of the invention allows a user to spin a towel 10 in a counter-clockwise direction or a clockwise direction and with greater ease than heretofore known. The spinning towel assembly of FIG. 1 includes a grip 40 by which the user may hold the assembly and spins the towel 10. The outer grip 40 may be made of any convenient material, such as, but not limited to, foam, rubber, plastic, and the like. The grip 40 may be made by injection molding or any other convenient manufacturing technique. The grip 40 may be soft and resilient to provide a nice surface for squeezing, similar to tension relief toys, or the grip 40 may be more rigid for including writing surfaces, engraving, or type-set information thereon. The grip 40 may also include an outer surface having various textures and images to suit the occasion. In one non-limiting example, the grip 40 is in the shape of a particular person, animal, mascot, trademark, emblem, or other image that conveys a particular meaning to be associated with the rally towel 10. For example, and without limiting the invention, the grip 40 may be in the shape of a ball or other piece of sporting equipment, such as a baseball (FIG. 5A) or a football (FIG. 5B). Other shapes, including soccer balls, basketballs, tennis balls, golf balls, hockey pucks, hockey sticks, and the like would also make useful grips 40. The shape of the grip, therefore, may coincide with a theme or an activity associated with a team or other group.

Figure 4A:
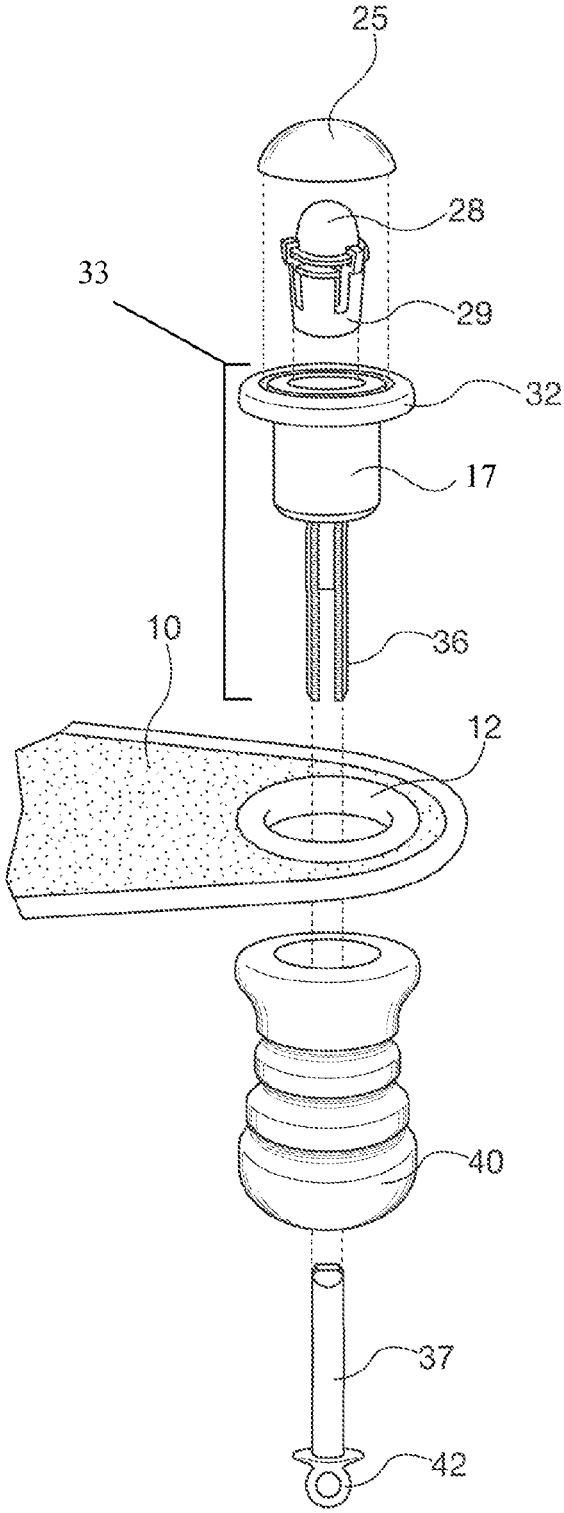
FIG. 4A depicts an exploded view of a spinning towel assembly.

Between the grip 40 and the towel 10 there is a collar 12 that allows the towel 10 to rotate about an axis. One example of this collar 12 is shown in FIG. 4A as a ring defining a hole in the towel 10. The collar 12 is typically made of a smooth material that is conducive to spinning about an axis. The collar 12, therefore, may be a metal, an alloy, a plastic, or any polished surface with a low coefficient of friction with an axis of rotation. In one example, the collar 12 is a grommet. FIG. 4A shows the collar 12 as fitting within and through the surface of the towel 10. In a different embodiment, the ring could be assembled on a side of the towel or connected to the towel by an intervening connector.

In one embodiment shown in FIG. 4A, the axis of rotation is a pin 33 that holds the grip 40 to the towel 10. The pin 33 connects through the collar 12 on the towel 10 in a position that allows rotation. In the example of FIG. 4A, the collar 12 (and therefore the towel 10) spins about a surface 17 on the pin 33. The pin 33 connects to the grip 40 in a way that leaves sufficient space 13 for the collar 12 to completely rotate about a surface 17 of the pin 33. In other words, the collar 12 in the assembly does not sit directly or tightly on the grip 40; the collar 12 fits within a space 13 defined between the collar 12 and the body 50 of the pin 33. See FIG. 4B. The collar 12, therefore, has sufficient room to spin about a surface 17 on the pin 33.

Figure 4B:
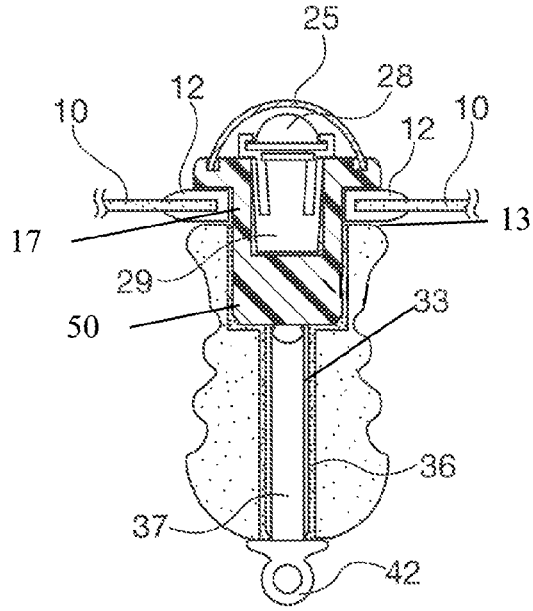
FIG. 4B depicts a cross sectional view of a spinning towel assembly.

According to one embodiment of the invention, the spinning towel assembly includes a light 28 by which light may be emitted from the lens 25. As shown in FIG. 4B, a casement portion 50 of the pin 33 fits within the grip 40. The casement 29 may house a battery 60 to provide a connection to the light 28 located within the lens 25. Multiple kinds of batteries are available for power and are within the scope of this invention. In a different embodiment, the spinning towel assembly utilizes a "tap light" that is turned on by the user tapping the spinning towel assembly, for example, in the palm of their hand, on a seat or bleacher, or on their leg. Any downward force proximate the tap light will cause the light to turn on. Tap lights and tap switches are well known in the art of electronic lighting equipment. The light on the spinning towel assembly may include the ability to provide a strobe effect. In yet another embodiment, the lens 28 may come in a variety of colors. For example, the color can correspond to the team color associated with the rally towel. The lighting portion of the rally towel assembly may come in a variety of forms and electrical configurations, including those that house a larger battery in the grip 40. While safety protocol leads to an assembly that cannot be disassembled, a configuration that allows for changing out a light 28 or a battery in the assembly is within the scope of this invention. Accordingly, the assembly may have a threaded portion that allows access to the light 28 for replacement. The light 28, of course, may be any conventional lighting apparatus, including light emitting diodes and the like.

Figure 6:
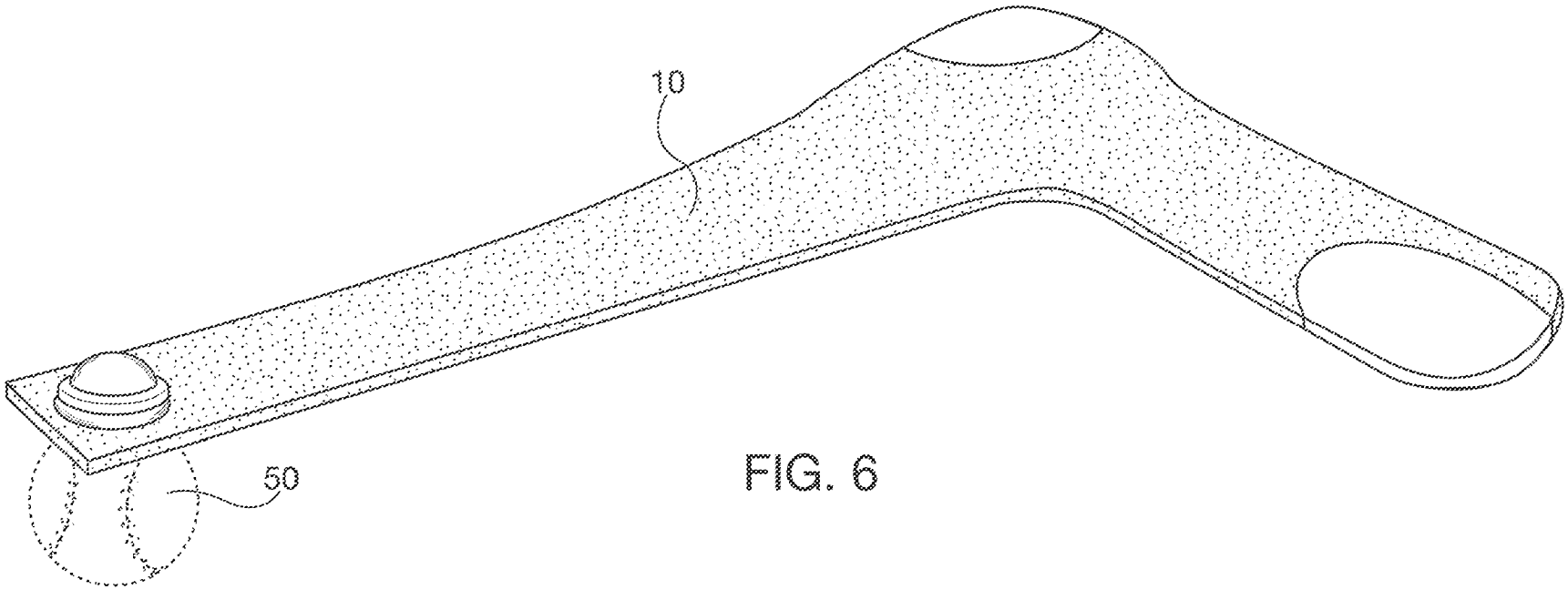

As used herein, a "towel" may be of any shape or dimension. According to one embodiment of the invention, the towel 10 is approximately triangular in shape with a length of approximately 21 inches and a height of approximately 8 inches. The shape of the towel 10 and images printed on the towel 10 may coincide with the mascot or any other image associated with the user's favorite sports team or other entity using the rally towel for advertisement. For example, as shown in FIG. 6, in another embodiment of the invention, a towel 10 is in the shape of a sock, which might be suitable for use in connection with the Boston Red Sox. According to one embodiment of the invention, a towel 10 may be made from printed felt which is die-cut to shape, for example in the shape of a sock. In another embodiment of the invention two or more towels may be included in a single spinning towel assembly. According to one embodiment, the towels 10 may be manufactured as a dual die-cut terrycloth towel with printing on the surface and a surged edge.

The towel 10 may include advertising material 9, for example, a team logo or mascot or sponsor information. Although the advertising material 9 is shown in the Figures as an "X", it is understood that the towels may include, without limitation, any text or graphics. The advertising material 9 may be applied to the towel by any method, including but not limited to application by printing, stickers or labels, and embroidery.

The spinning towel assembly may include an advertisement tag 11, which may also include advertising content 11. This advertisement tag 11 may be, for example, a key ring that is provided by a sponsor and includes a sponsor's logo or other information. The advertisement tag 11 may be introduced by the manufacturer during assembly, or the advertisement tag 11 may be added at any later point by a sponsor or other entity. As shown in FIG. 4A, an exploded view of the FIG. 1 spinning towel assembly, the advertisement tag 11, may be attached to the grip 40 via a ring 42.

The spinning towel assembly may include an outer foam grip 40 or a grip that is more specifically tailored to the applicable sport or event. For example, as shown in FIGS. 5A and 5B, the grip 40 may be shaped and decorated as a baseball 50 or a football 60. It is understood that the grip may also be formed in the shape of other sports items that are not shown in the Figures, for example, a grip may be shaped and decorated as a soccer ball or a hockey stick. The towel may also be designed to cover an entire sport, regardless of the team (i.e., a NASCAR towel may be a simple black and white checkered flag). One other embodiment of the spinning towel assembly includes noisemakers that are activated by the spinning (e.g., a ratchet assembly by which a post engages a gear and makes a continuous noise).

The exploded view of FIG. 4A shows each part of one example of a rally towel according to the invention herein. The towel 10 defines an opening that is encircled by the collar 12. The collar 12 is designed to have a low coefficient of friction against the pin 33 at a surface 17 on the pin. The pin 33 includes a cavity for receiving a lighting assembly and/or a battery as shown in the Figure as encasement 29, light or LED 28, and lens 25. The pin 33 is characterized in part by its attachment to the grip. The pin 33 includes downward pointing legs or retaining prongs 36 that fit through the collar 12 and into a receptacle within the grip 40. At the opposite end of the grip 40, an opening allows the entry of a mating clip 37 that has another pair of upwardly extending mating prongs 37 designed to slide into the retaining prongs 36 of the pin 33. The prongs 36 on the pin and the mating clip 37 engage one another to hold the pin 33 within the grip 40. From another view, the pin 33 has pairs of beveled edges that run down retaining prongs 36. The mating clip 37 has mating prongs that are spaced perpendicularly to one another, and each of the mating prongs also have beveled edges that run the length of the mating prongs. The mating prong edges and the retaining prong edges are suitable to engage one another to hold the pin in place within the grip 40. In one embodiment, the edges of all four prongs in the pin and mating clip assembly (36, 37) join to form a hollow rectangular enclosure that is securely held together at opposite edges. As shown in FIG. 4A, the mating clip 37 may include a ring 42 for attaching an item 11 as shown in FIG. 1. The pin 33 mates with the clip 37 to hold the pin 33 a defined distance above the collar 12, thereby exposing a surface 17 around which the collar spins freely. In certain embodiments, the overall assembly is glued or held together by adhesives and does not come apart. For other applications, the interior of the rally towel assembly and its component parts may be accessible to interchange parts.

The shape of the towel 10 may be designed similarly to an airplane wing for better aerodynamics. For example, as shown in FIG. 1, the towel may include a leading edge 15 and a trailing edge 16. A chord 3 defines the distance between the two. During clockwise rotation as shown in FIG. 1, the leading edge 15 is thicker than the trailing edge 16 (shown with hash marks). This difference in thickness may be accomplished by folding, hemming, embroidering, or any other surface treatment that changes the thickness of a portion of the towel 10. The thickness difference between the leading edge 15 and the trailing edge 16 is designed to provide better lift to the towel assembly. The leading edge 15 directs the air over the top surface of the towel 10 at a lower pressure than the bottom, leading to lift. The curvature formed by the difference in thickness from the leading edge 15 to the trailing edge 16 enhances the lift of the towel 10 and makes it easier to spin. The difference in thickness also maintains rotation longer due to the enhanced lift. Without limiting the invention in any way, one theory of operation of the rally towel 10 is that by making the leading edge 15 of the towel thicker, the additional weight in the front section of the wing leads to upward curvature across the chord 3 of the towel from the leading edge 15 toward the trailing edge 16. This curvature enhances a pressure difference between the bottom surface (high pressure) and the top surface (lower pressure) that lifts the towel 10.

The towel 10 may also be characterized in its tapered shape shown in FIG. 1. The towel 10 is wider at the end farthest from the grip 40 (the distal end) and narrowest directly adjacent the grip 40 (the proximal end). This tapered shape provides a high aspect ratio, defined as the square of the wing span (the length from the end nearest the grip to the end farthest from the grip) divided by the wing area. The high aspect ratio reduces the drag and helps maintain the rotation of the towel 10 about its axis. The shape of the towel 10 may be varied for different performance criteria. For example, the towels of FIGS. 5A and 5B are less tapered for a different feel and drag intensity. The tapering is characterized in terms of the rate of change of the chord dimension 3. By incorporating certain features of an airplane wing into a rally towel, the device disclosed herein meets a need in the industry for a higher performing spinning towel assembly.

The description herein is for exemplary purposes only. The invention is shown by example in the associated drawings.

The invention claimed is:

1. A spinning towel device comprising:

a towel defining an opening;

a grip;

a pin extending through the opening in the towel and into a first end of said grip, said pin comprising retaining prongs;

a mating clip extending into a second end of said grip, said mating clip comprising mating prongs that engage said retaining prongs of said pin to hold said pin within said grip and defining an exposed surface on said pin, wherein the opening in said towel is adjacent said exposed surface on said pin;

a ring attached to said mating clip;

a light attached to said pin, wherein said light is a tap light;

a collar engaging the opening in said towel, wherein said collar engages said exposed surface on said pin, wherein said towel comprises a leading edge and a trailing edge, and said leading edge is thicker than said trailing edge, and wherein said towel is tapered from an edge adjacent said pin toward an opposite edge.

2. A spinning towel device according to claim 1, wherein said grip is in the shape of a ball.

* * * * *